US011383949B2

(12) United States Patent
Ito et al.

(10) Patent No.: US 11,383,949 B2
(45) Date of Patent: Jul. 12, 2022

(54) MEDIUM LOADING DEVICE

(71) Applicant: SEIKO EPSON CORPORATION, Tokyo (JP)

(72) Inventors: Shun Ito, Shiojiri (JP); Yosuke Nakano, Matsumoto (JP); Keiichi Yato, Matsumoto (JP); Haruna Takahashi, Minamiminowa-mura (JP)

(73) Assignee: Seiko Epson Corporation, Tokyo (JP)

( * ) Notice: Subject to any disclaimer, the term of this patent is extended or adjusted under 35 U.S.C. 154(b) by 57 days.

(21) Appl. No.: 16/934,696

(22) Filed: Jul. 21, 2020

(65) Prior Publication Data

US 2021/0024320 A1 Jan. 28, 2021

(30) Foreign Application Priority Data

Jul. 22, 2019 (JP) ..... JP2019-134355

(51) Int. Cl.
*B65H 31/26* (2006.01)
*B41J 13/10* (2006.01)

(52) U.S. Cl.
CPC ..... *B65H 31/26* (2013.01); *B41J 13/106* (2013.01)

(58) Field of Classification Search
CPC .... B65H 2405/1412; B65H 2404/7414; B65H 2404/74; B65H 2404/694; B65H 2404/64; B65H 2404/69
See application file for complete search history.

(56) References Cited

U.S. PATENT DOCUMENTS

2009/0102111 A1* 4/2009 Tokuno ..... G03G 15/6544 270/58.07
2012/0147112 A1* 6/2012 Tanaka ..... B65H 31/26 347/104
2012/0242035 A1* 9/2012 Yoshida ..... B65H 31/20 271/220
2017/0066616 A1* 3/2017 Endo ..... B65H 45/18
2017/0087887 A1* 3/2017 Hirata ..... B65H 31/34
2017/0152122 A1* 6/2017 Deocon Mir ..... B65H 43/06

FOREIGN PATENT DOCUMENTS

JP H11-165935 6/1999
JP 2007091403 A * 4/2007
JP 2016003129 A * 1/2016

* cited by examiner

*Primary Examiner* — Jennifer Bahls
(74) *Attorney, Agent, or Firm* — Workman Nydegger

(57) ABSTRACT

Provided are a loading portion configured to load a medium discharged from a discharging portion, and a plurality of pressing portions provided downstream of the discharging portion in a discharging direction of the medium, and configured to press the medium loaded on the loading portion. The loading portion includes a first loading portion including a downward sloped surface sloping downward in the discharging direction, and also includes a second loading portion including an upward sloped surface sloping upward in the discharging direction. The downward sloped surface and the upward sloped surface form a discharging path through which the medium is discharged. The plurality of pressing portions includes a first pressing portion configured to press the medium loaded on the first loading portion, and also includes a second pressing portion configured to press the medium loaded on the second loading portion.

9 Claims, 8 Drawing Sheets

MEDIUM LOADING DEVICE

The present application is based on, and claims priority from JP Application Serial Number 2019-134355, filed on Jul. 22, 2019, the disclosure of which is hereby incorporated by reference herein in its entirety.

BACKGROUND

1. Technical Field

The present disclosure relates to a medium loading device.

2. Related Art

For example, a sheet post-processing device (for example, a medium loading device) configured to carry a medium discharged from a copying device (for example, printing apparatus) is proposed (for example, JP-A-11-165935).

The medium loading device described in JP-A-11-165935 is mounted at a side portion of the printing apparatus. A medium discharged from the printing apparatus is loaded on a sheet discharge tray. The sheet discharge tray has a raised ridge that is raised from a loading surface of the sheet discharge tray. The raised ridge corrects an angle of a leading edge portion of the medium relative to the loading surface of the sheet discharge tray. The raised ridge optimizes the angle formed by the medium and the loading surface when the medium is loaded on the sheet discharge tray. This prevents the leading edge of the medium from being rounded, which allows the medium to be discharged appropriately along the loading surface of the sheet discharge tray.

However, when the raised ridge is provided in the discharge path through which the medium is discharged, the raised ridge may block the discharging of the medium, preventing the medium from being appropriately discharged to the sheet discharge tray.

SUMMARY

A medium loading device provides a medium loading device used for a printing apparatus including a discharging portion discharging a medium, the medium loading device including: a loading portion configured to load the medium discharged from the discharging portion; and a plurality of pressing portions provided downstream of the discharging portion in a discharging direction of the medium, the plurality of pressing portions being configured to press the medium loaded on the loading portion, wherein the loading portion includes: a first loading portion that includes a downward sloped surface sloping downward in the discharging direction and that is provided downstream of the discharging portion in the discharging direction; and a second loading portion that includes an upward sloped surface sloping upward in the discharging direction and that is provided downstream of the first loading portion in the discharging direction, the downward sloped surface and the upward sloped surface form a discharging path through which the medium is discharged, and the plurality of pressing portions include: a first pressing portion configured to press the medium loaded on the first loading portion; and a second pressing portion configured to press the medium loaded on the second loading portion.

A medium loading device provides a medium loading device used for a printing apparatus including a discharging portion discharging a medium, and a first loading portion configured to load the medium, the first loading portion including a downward sloped surface sloping downward in the discharging direction and provided downstream in a discharging direction, in which the discharging portion discharges the medium, the medium loading device including: a second loading portion configured to load the medium and including an upward sloped surface sloping upward in the discharging direction and provided downstream of the first loading portion in the discharging direction; and a plurality of pressing portions configured to press the medium loaded on the first loading portion and the second loading portion, and provided downstream of the discharging portion in the discharging direction, wherein the plurality of pressing portions includes: a first pressing portion configured to press the medium loaded on the first loading portion; and a second pressing portion configured to press the medium loaded on the second loading portion.

DESCRIPTION OF EXEMPLARY EMBODIMENTS

1. Exemplary Embodiment 1.1 Printing System

Figure 1:
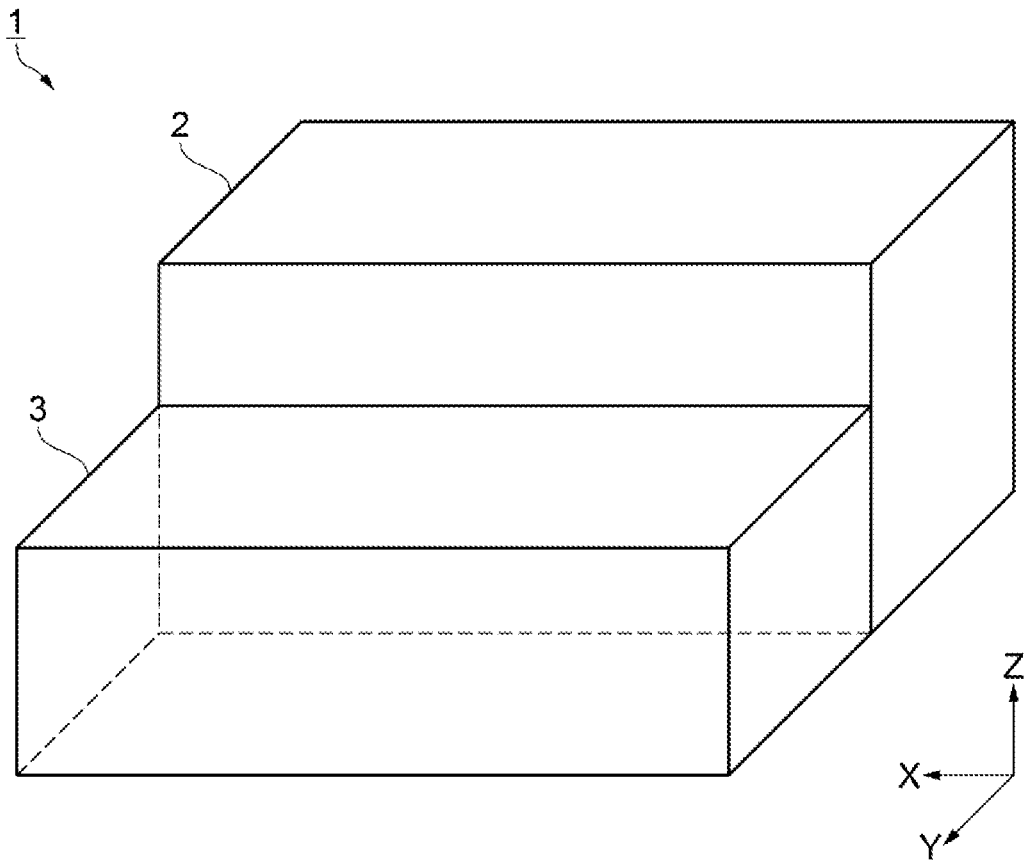
FIG. 1 is a schematic view of a printing system including a medium loading device according to an exemplary embodiment 1.

FIG. 1 is a schematic view of a printing system 1 including a medium loading device 3 according to an exemplary embodiment. As illustrated in FIG. 1, the printing system 1 includes a printing apparatus 2 and the medium loading device 3 according to the present exemplary embodiment.

The printing apparatus 2 is an inkjet-type large-sized printer having a substantially rectangular parallelepiped shape and capable of performing printing on a medium 22 having a short lateral width of at least A3 (297 mm). The printing apparatus 2 rotatably holds a roll body 25 (see FIG. 2) around which the medium 22 has been wound in a roll shape, and prints an image or the like on the medium 22 by blowing ink onto the surface of the medium 22 pulled out from the roll body 25.

The medium 22 on which the image has been printed is cut into a predetermined dimension, and is discharged from a discharging portion 18 (see FIG. 2) toward the medium loading device 3.

The medium loading device 3 carries the medium 22 discharged from the discharging portion 18 of the printing apparatus 2. The type of medium 22 to be loaded on the medium loading device 3 varies widely. For example, a medium 22 having a large bending rigidity such as a photographic sheet, or a medium 22 such as a plain sheet having a lower bending rigidity than that of the photographic sheet is used. The size of the medium 22 loaded on the medium loading device 3 also varies widely. For example, media 22 having a size ranging from A0 size to A4 size are loaded on the medium loading device 3 in a mixed manner.

Hereinafter, a medium 22 having a large bending rigidity such as a photographic sheet is referred to as a rigid medium 22A. A medium 22 such as a plain sheet having a lower bending rigidity than that of a photographic sheet is referred to as a soft medium 22B. Note that the expressions "rigid" and "soft" do not specifically limit the values of bending rigidity as well as the range of bending rigidity. That is, it is only necessary that the bending rigidity of the rigid medium 22A is relatively larger than the bending rigidity of the soft medium 22B, or the bending rigidity of the soft medium 22B is relatively smaller than the bending rigidity of the rigid medium 22A.

In the following description, the longitudinal direction of the printing apparatus 2 having a substantially rectangular parallelepiped shape is set as an X direction. The shorter-side direction of the printing apparatus 2 having a substantially rectangular parallelepiped shape is set as a Y direction. The height direction of the printing apparatus 2 having a substantially rectangular parallelepiped shape is set as a Z direction. In addition, a top side of an arrow indicating the direction is set as a (+) direction, and a base end side of the arrow indicating the direction is set as a (−) direction.

Note that the X direction is an example of an intersecting direction that intersects a discharging direction in the present application.

1.2 Printing Apparatus

Figure 2:
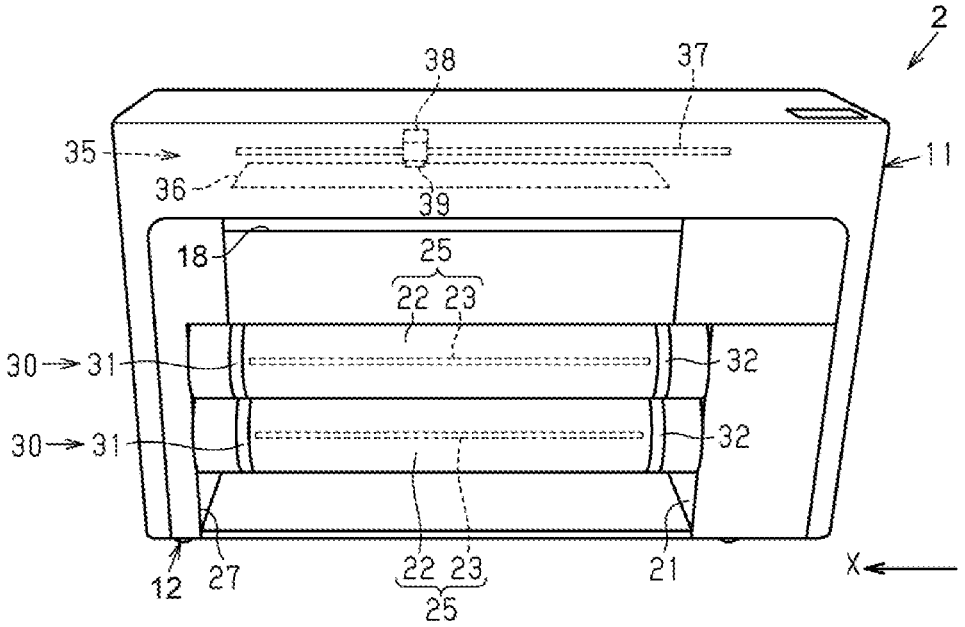
FIG. 2 is a perspective view of a schematic configuration of a printing apparatus.
Figure 3:
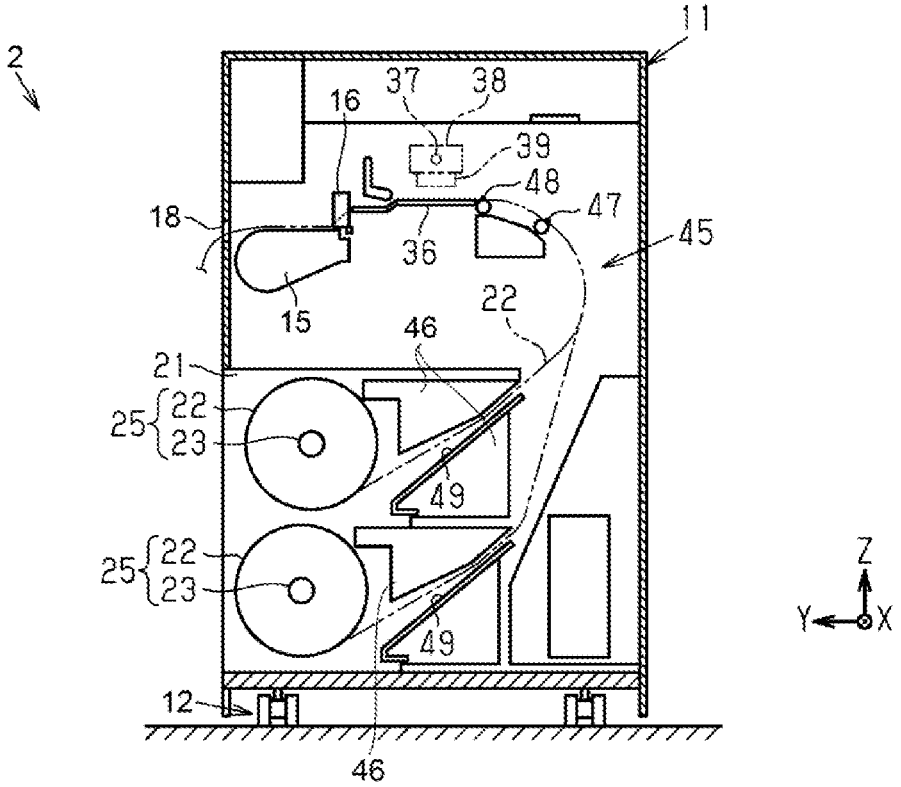
FIG. 3 is a cross-sectional view schematically illustrating an internal structure of the printing apparatus.

FIG. 2 is a perspective view of a schematic configuration of the printing apparatus 2. FIG. 3 is a cross-sectional view schematically illustrating an internal structure of the printing apparatus 2.

As illustrated in FIGS. 2 and 3, the printing apparatus 2 includes a main body 11 having a substantially rectangular parallelepiped shape and a leg portion 12.

The main body 11 includes an accommodating portion 21 disposed on the −Z direction side, a recording unit 35 disposed on the +Z direction side, and a transport unit 45 that transports, to the recording unit 35, the medium 22 unwound from the roll body 25 accommodated in the accommodating portion 21.

The accommodating portion 21 has an opening 27 on the +Y direction side, and can accommodate a pair of roll bodies 25 in a state where they are arranged in the Z direction. A pair of holding units 30 that are rotatably mounted on the main body 11 are attached to each of the pair of roll bodies 25 accommodated in the accommodating portion 21. The holding units 30 each include a first holding unit 31 that holds one end of the roll body 25, and a second holding unit 32 that holds the other end of the roll body 25. The first holding unit 31 and the second holding unit 32 can be detached from the main body 11 through the opening 27.

With the first holding unit 31 and the second holding unit 32 holding the roll body 25, the holding units 30 hold the roll body 25 in a rotatable manner around the central axis of a core member 23. The roll body 25 held by the first holding unit 31 and the second holding unit 32 is driven to rotate by a drive portion (not illustrated).

The recording unit 35 includes a support 36, a guide shaft 37, a carriage 38, and a recording head 39.

The support 36 is a plate member extending in the X direction. After unwound from the roll body 25, the medium 22 is transported to the support 36, and then, is transported in the +Y direction on the support 36.

The guide shaft 37 is located on the +Z direction side of the support 36. The guide shaft 37 is a rod-like member extending in the X direction. The guide shaft 37 supports the carriage 38 in a movable manner along the guide shaft 37. With a carriage motor (not illustrated) being driven, the carriage 38 is configured to be able to reciprocally move along the guide shaft 37.

The recording head 39 is mounted on the carriage 38. The recording head 39 is located on the support 36 side with respect to the carriage 38. The recording head 39 performs printing on the medium 22 by blowing ink onto the medium 22 supported by the support 36.

The transport unit 45, in cooperation with the holding unit 30, transports the medium 22 unwound from the roll body 25. The transport unit 45 includes a transport-path forming portion 46, an intermediate roller 47, and a transport roller 48. With a not-illustrated driving motor driving in a forward direction to cause the intermediate roller 47 and the transport roller 48 to rotate and drive, the transport unit 45 transports the medium 22 through a transport path 49 to the support 36, and also transports it on the support 36 toward the discharging portion 18.

Note that FIG. 2 illustrates a state in which the medium 22 is sent out from both of the pair of roll bodies 25. However, in reality, the medium 22 is sent out only from either one of the pair of roll bodies 25 at the time of actual printing.

Furthermore, the main body 11 includes a paper exit member 15 and a cutting portion 16, each of which is disposed downstream of the support 36 in a direction in which the medium 22 is transported. The paper exit member 15 supports the medium 22 passing through the support 36, and guides the medium 22 to the discharging portion 18. The cutting portion 16 cuts the medium 22 into a predetermined dimension. The medium 22 cut by the cutting portion 16 is discharged from the discharging portion 18.

1.3 Medium Loading Device

Figure 4:
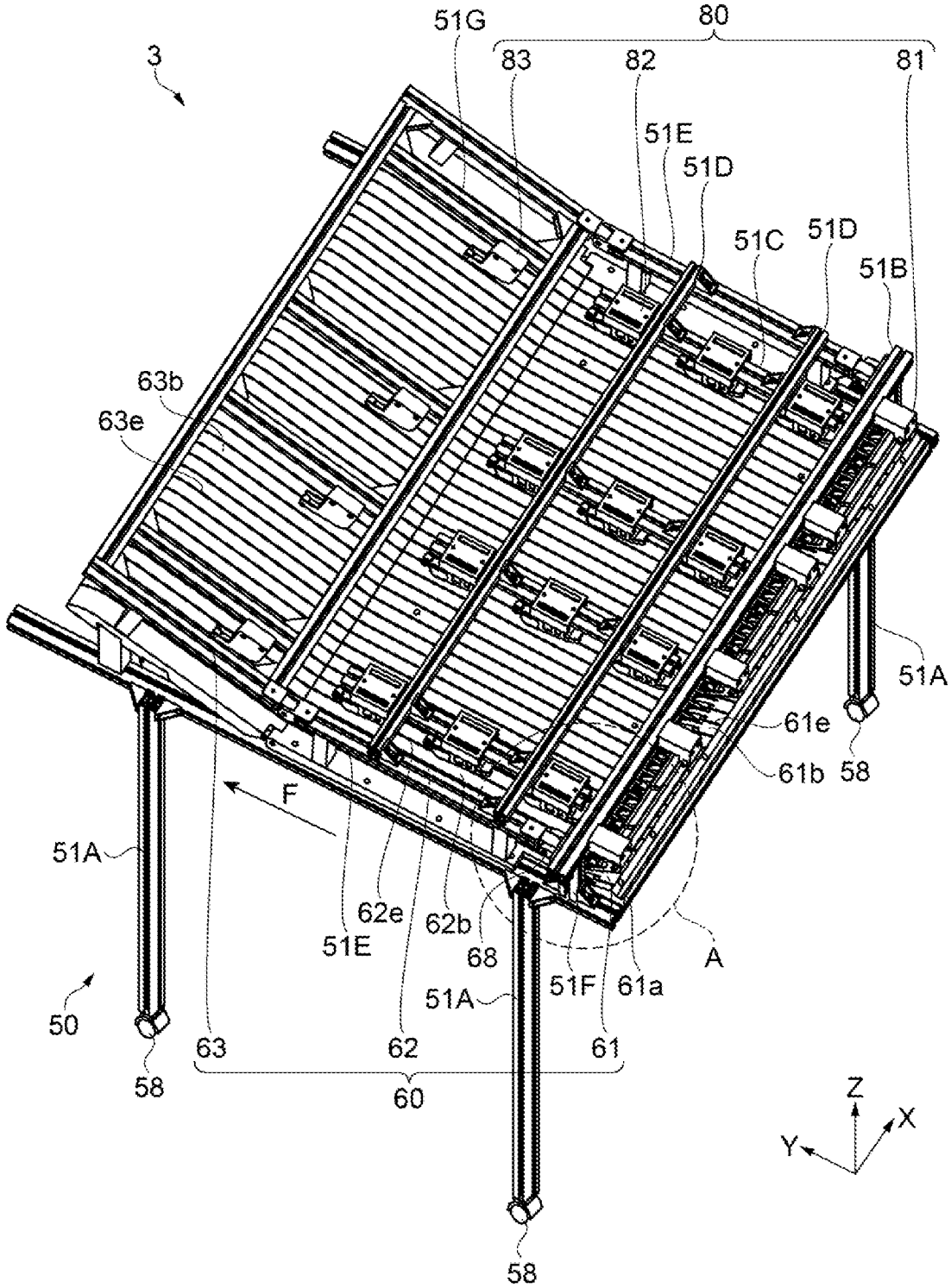
FIG. 4 is a perspective view of a medium loading device according to the exemplary embodiment 1.
Figure 5:
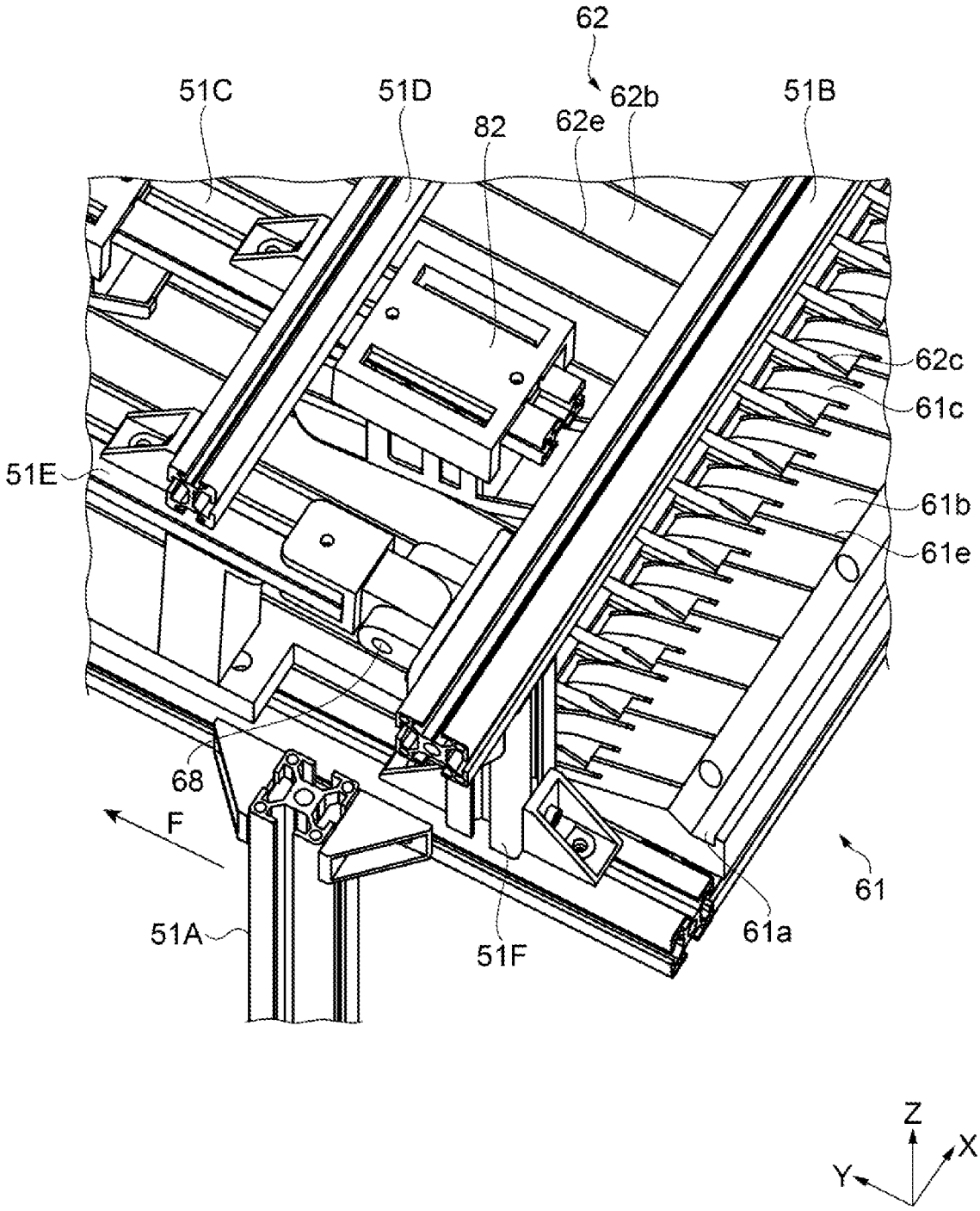
FIG. 5 is an enlarged view of a region A surrounded by the dashed line in FIG. 4.
Figure 6:
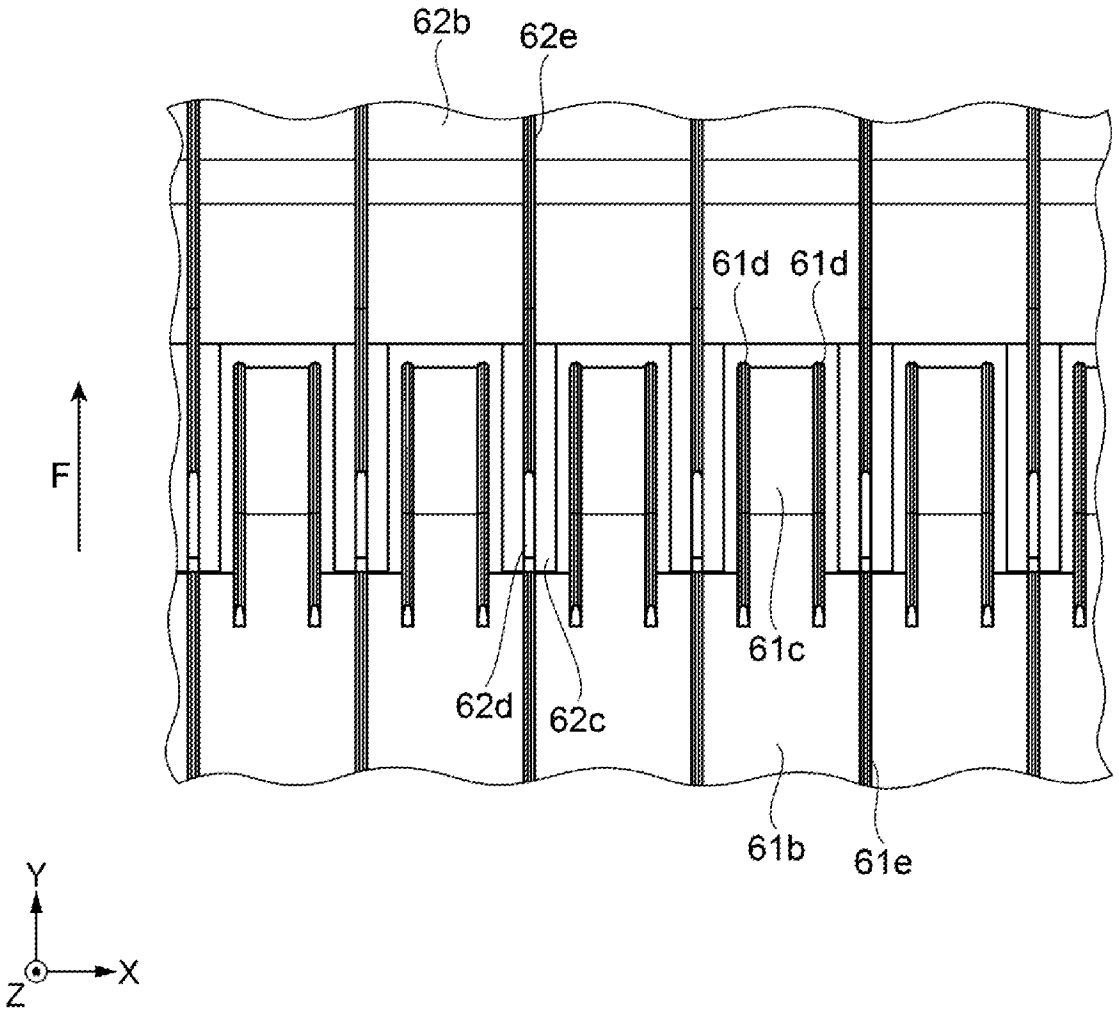
FIG. 6 is an enlarged view of a boundary portion between a first loading portion and a second loading portion.
Figure 7:
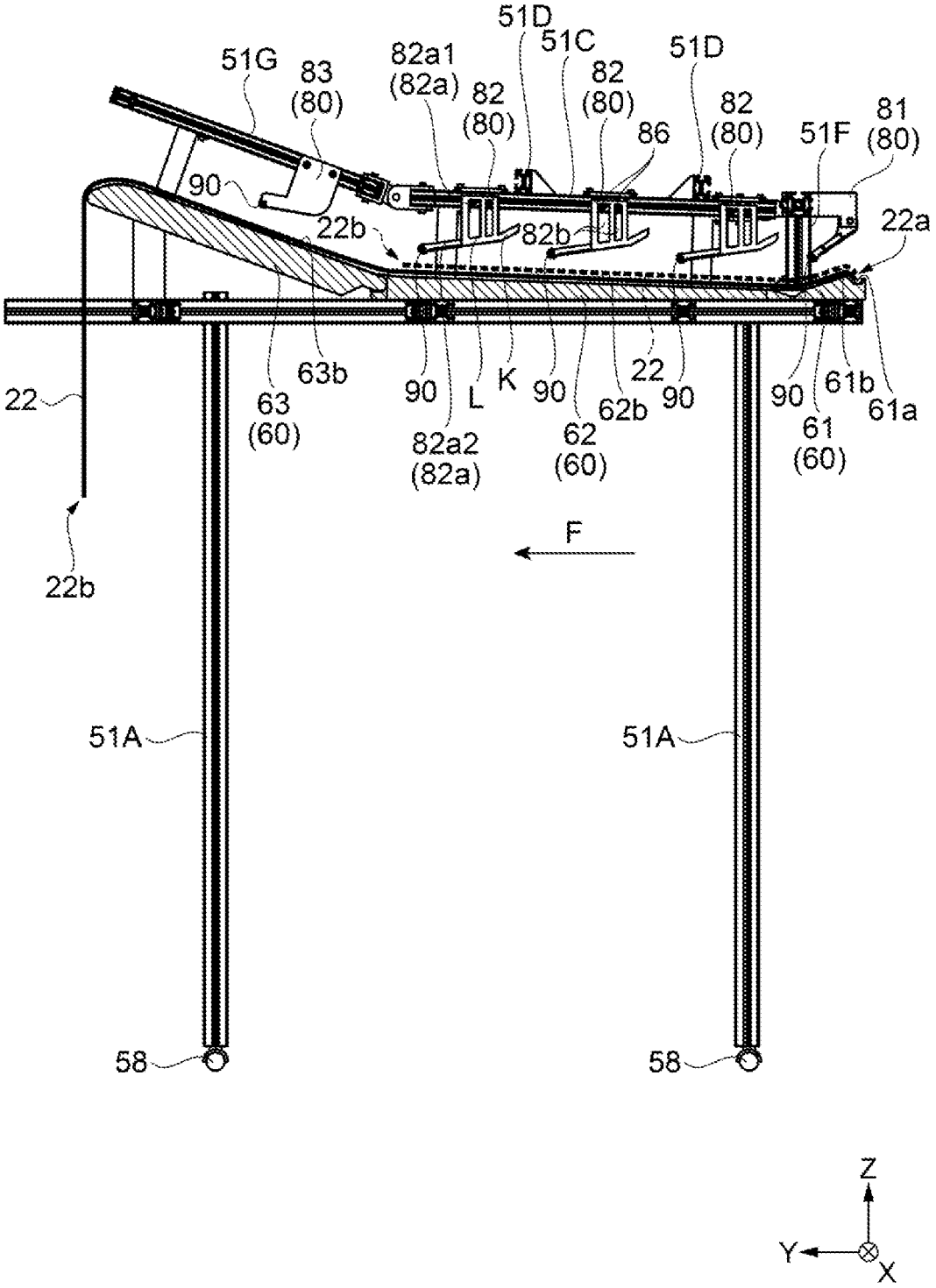
FIG. 7 is a cross-sectional view illustrating a state of the medium loading device according to the exemplary embodiment 1.
Figure 8:
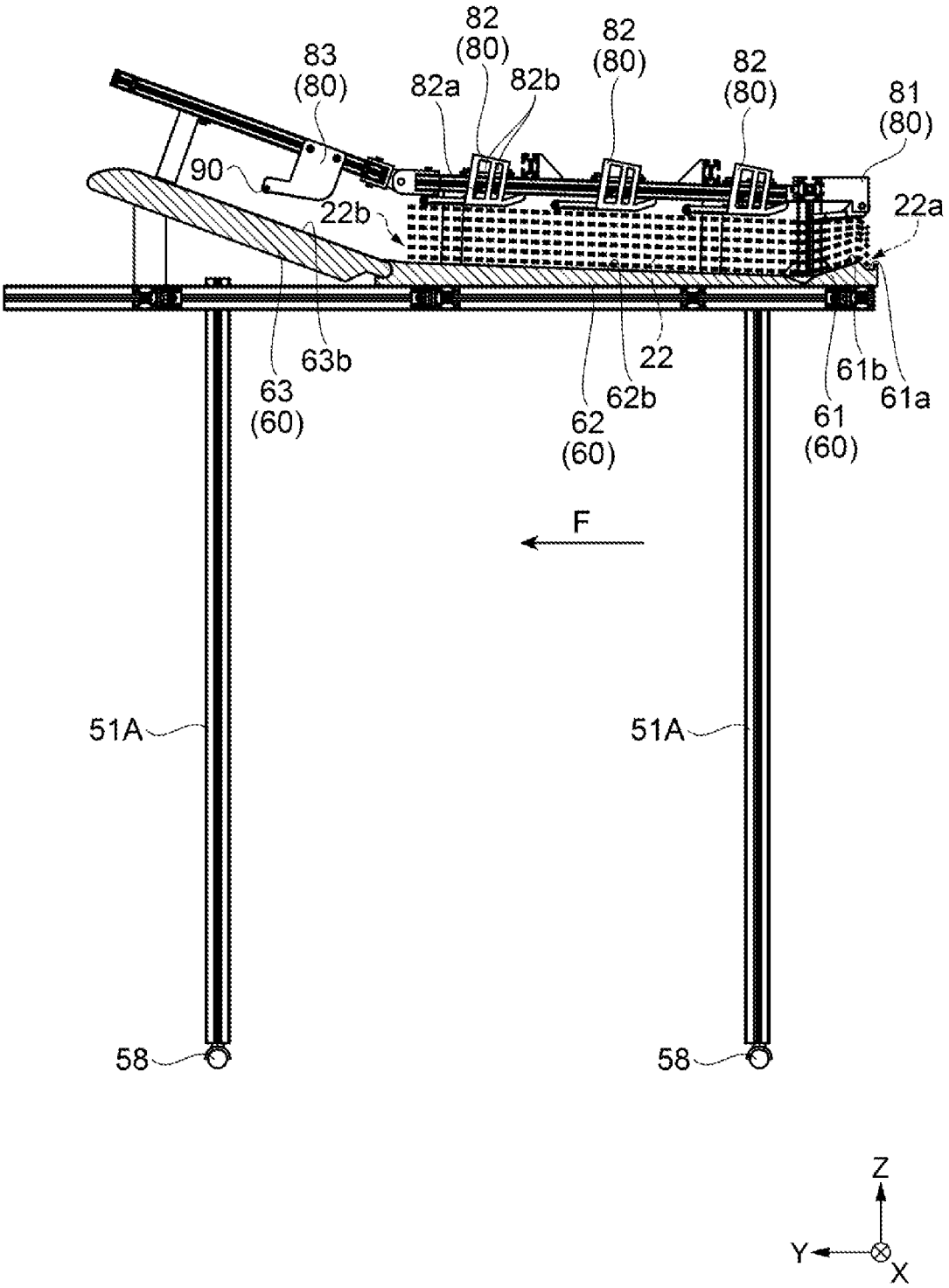
FIG. 8 is a cross-sectional view illustrating a state of the medium loading device according to the exemplary embodiment 1.

FIG. 4 is a perspective view of the medium loading device 3 according to the present exemplary embodiment. FIG. 5 is an enlarged view of a region A surrounded by the dashed line in FIG. 4. FIG. 6 is an enlarged view of a boundary portion between a first loading portion 61 and a second loading portion 62. FIGS. 7 and 8 are cross-sectional views each illustrating a state of the medium loading device 3 according to the present exemplary embodiment.

Note that FIG. 6 is a diagram when viewed in the Z direction. FIGS. 7 and 8 are diagrams when viewed in the X direction. In FIG. 5, a first pressing portion 81 is not illustrated in order to facilitate understanding of the state of the boundary portion between the first loading portion 61 and the second loading portion 62. In FIG. 7, a medium 22 with A1 size is illustrated with the thick solid line, and a medium 22 with A3 size is illustrated with the thick dashed line. In FIG. 8, a plurality of media 22 with A3 size loaded on the medium loading device 3 is illustrated with the thick dashed line.

As illustrated in FIGS. 4 to 8, the medium loading device 3 includes a base portion 50, a loading portion 60 that can carry the medium 22 discharged from the discharging portion 18, and a plurality of pressing portions 80 that can press the medium 22 loaded on the loading portion 60.

The base portion 50 includes a plurality of frames 51, and supports the loading portion 60 and the pressing portions 80. The base 50 has four frames 51A each extending in the Z direction. The four frames 51A support other frames 51 of the base portion 50, the loading portion 60, and the pressing portions 80. A caster 58 is attached at the end of each of the four frames 51A on the −Z direction side, allowing the medium loading device 3 to move with the caster 58.

In a case of the printing system 1, the medium loading device 3 is moved to detach the roll body 25 from the accommodating portion 21 of the printing apparatus 2 or attach the roll body 25 to the accommodating portion 21 of the printing apparatus 2.

The loading portion 60 is a portion where a medium 22 having an image printed thereon and cut into a predetermined dimension is loaded. The medium 22 that has been cut into a predetermined dimension is discharged from the discharging portion 18 of the printing apparatus 2 in the discharging direction F (hereinafter, simply referred to as a discharging direction F) of the medium 22 indicated by the arrow in the drawing, and is loaded on the loading portion 60.

The loading portion 60 includes the first loading portion 61, the second loading portion 62, and a third loading portion 63. The first loading portion 61, the second loading portion 62, and the third loading portion 63 are arranged sequentially along the discharging direction F. The first loading portion 61 is provided downstream of the discharging portion 18 of the printing apparatus 2 in the discharging direction F. The second loading portion 62 is provided downstream of the first loading portion 61 in the discharging direction F. The third loading portion 63 is provided downstream of the second loading portion 62 in the discharging direction F. In particular, when the medium loading device 3 is disposed in the +Y direction with respect to the printing apparatus 2, the first loading portion 61 is located downstream of the discharging portion 18 of the printing apparatus 2 in the discharging direction F. In other words, the medium loading device 3 is moved with the caster 58 so that the first loading portion 61 is positioned downstream of the discharging portion 18 of the printing apparatus 2 in the discharging direction F. This allows the installation position to be adjusted with respect to the printing apparatus 2.

In other words, the loading portion 60 includes the first loading portion 61 provided downstream of the discharging portion 18 in the discharging direction F, the second loading portion 62 provided downstream of the first loading portion 61 in the discharging direction F, and the third loading portion 63 provided downstream of the second loading portion 62 in the discharging direction F.

A groove 61*a* recessed toward the −Z direction is form in the first loading portion 61 and on the upstream side in the discharging direction F. The groove 61*a* is a recess extending in the X direction. In addition, the first loading portion 61 has a sloped surface 61*b* sloped in a manner such that the upstream side in the discharging direction F is higher and the downstream side in the discharging direction F is lower. In other words, the first loading portion 61 has a downward sloped surface 61*b* provided downstream of the discharging portion 18 of the printing apparatus 2 in the discharging direction F, the downward sloped surface 61*b* being configured to be sloped downward toward the discharging direction F. Hereinafter, the downward sloped surface 61*b* configured to be sloped downward toward the discharging direction F of the first loading portion 61 is referred to as a downward sloped surface 61*b*.

The second loading portion 62 has a sloped surface 62*b* sloped in a manner such that the upstream side in the discharging direction F is lower and the downstream side in the discharging direction F is higher. In other words, the second loading portion 62 has an upward sloped surface 62*b* provided downstream of the first loading portion 61 in the discharging direction F, the upward sloped surface 62*b* being configured to be sloped upward toward the discharging direction F. Hereinafter, the upward sloped surface 62*b* configured to be sloped upward toward the discharging direction F of the second loading portion 62 is referred to as an upward sloped surface 62*b*.

Note that the intersecting direction described above is a direction intersecting the discharging direction F and extending along the downward sloped surface 61*b* and the upward sloped surface 62*b*.

The third loading portion 63 includes a sloped surface 63*b* sloped in a manner such that the upstream side in the discharging direction F is lower and the downstream side in the discharging direction F is higher. In other words, the third loading portion 63 includes a sloped surface 63*b* provided downstream of the second loading portion 62 in the discharging direction F.

The sloped surface 63*b* has an uphill gradient greater than the uphill gradient that the upward sloped surface 62*b* has. In other words, the sloped surface 63*b* is steeper than the upward sloped surface 62*b*. By setting the sloped surface 63*b* to be steeper than the upward sloped surface 62*b*, it is possible to reduce the size (size of the medium loading device 3 in the Y direction) of the medium loading device 3 in the discharging direction F, and achieve miniaturization of the medium loading device 3, as compared with a case where the sloped surface 63*b* is set to be gentler than the upward sloped surface 62*b*.

As illustrated in FIG. 5, a plurality of downward sloped protrusions 61*c* protruding in the discharging direction F is provided at the end of the first loading portion 61 in the discharging direction F. The plurality of downward sloped protrusions 61*c* constitutes a portion of the downward sloped surface 61*b*. A plurality of upward sloped protrusions 62*c* protruding in a direction opposite to the discharging direction F is provided at the end of the second loading portion 62 in the direction opposite the discharging direction F. The plurality of upward sloped protrusions 62*c* constitutes a portion of the upward sloped surface 62*b*.

Each of the plurality of downward sloped protrusions 61*c* and each of the plurality of upward sloped protrusions 62*c* are disposed alternately in the intersecting direction (X direction) that intersects the discharging direction F, and partially overlap when viewed in the X direction.

Note that the downward sloped protrusion 61*c* is an example of the first protrusion according to the present application. The upward sloped protrusion 62*c* is an example of the second protrusion according to the present application.

As illustrated in FIG. 6, a convex portion 61*d* extending in the discharging direction F is provided at each of the end of the downward sloped protrusion 61*c* on the +X direction side and the end of the downward sloped protrusion 61*c* on the −X direction side. In other words, the convex portion 61*d* extending in the discharging direction F is provided on both end portions of the downward sloped protrusion 61*c* in the X direction. The width of the convex portion 61*d* along the X direction is smaller than the width of the downward sloped protrusion 61*c* along the X direction.

When a medium 22 discharged in the discharging direction F travels over the downward sloped protrusion 61*c*, the medium 22 is in contact with the convex portion 61*d* provided on the downward sloped protrusion 61*c*, rather than being in contact with the entire downward sloped protrusion 61*c*. That is, the medium 22 comes into partial contact with the downward sloped protrusion 61*c*. When the medium 22 is brought into partial contact with the downward sloped protrusion 61*c*, the contact area between the medium 22 and the downward sloped protrusion 61*c* is smaller, as compared with a case where the medium 22 is brought into contact with the entire downward sloped protrusion 61*c*. This facilitates the discharging of the medium 22 in the discharging direction F on the downward sloped protrusion 61*c*.

The upward sloped protrusion 62*c* includes a convex portion 62*d* extending in the discharging direction F, the convex portion 62*d* being provided at a position equidistant between the end of the upward sloped protrusion 62*c* on the +X direction side and the end of the upward sloped protrusion 62*c* on the −X direction side. In other words, the upward sloped protrusion 62*c* includes the convex portion 62*d* extending in the discharging direction F, the convex portion 62*d* being provided so as to pass through the center of the upward sloped protrusion 62*c* in the X direction. The width of the convex portion 62*d* along the X direction is smaller than the width of the upward sloped protrusion 62*c* along the X direction.

When a medium 22 discharged in the discharging direction F travels over the upward sloped protrusion 62*c*, the medium 22 is in contact with the convex portion 62*d* provided on the upward sloped protrusion 62*c*, rather than being in contact with the entire upward sloped protrusion 62*c*. In other words, the medium 22 comes into partial contact with the upward sloped protrusion 62*c*. When the medium 22 is brought into partial contact with the upward sloped protrusion 62*c*, the contact area between the medium 22 and the upward sloped protrusion 62*c* is smaller, as compared with a case where the medium 22 is brought into contact with the entire upward sloped protrusion 62*c*. This facilitates the discharging of the medium 22 in the discharging direction F over the upward sloped protrusion 62*c*.

Note that it may be possible to employ a configuration in which the convex portion 61*d* is provided only on the downward sloped protrusion 61*c*, or a configuration in which the convex portion 62*d* is provided only on the upward sloped protrusion 62*c*, or a configuration in which the convex portion 61*d*, 62*d* is provided on both the downward sloped protrusion 61*c* and the upward sloped protrusion 62*c*. In other words, it is only necessary that the convex portion according to the present application is provided on at least one of the downward sloped protrusion 61*c* and the upward sloped protrusion 62*c*.

As illustrated in FIGS. 4 and 5, in the first loading portion 61, a convex portion 61*e* extending in the discharging direction F is provided on the downward sloped surface 61*b*, in addition to the convex portion 61*d* provided on the downward sloped protrusion 61*c*. In the second loading portion 62, a convex portion 62*e* extending in the discharging direction F is provided on the upward sloped surface 62*b*, in addition to the convex portion 62*d* provided on the upward sloped protrusion 62*c*. In the third loading portion 63, a convex portion 63*e* extending in the discharging direction F is provided on the sloped surface 63*b*.

When the medium 22 discharged in the discharging direction F travels over the downward sloped surface 61*b*, provision of the convex portion 61*e* extending in the discharging direction F brings a state in which the medium 22 is partially raised from the downward sloped surface 61*b* due to the convex portion 61*e*. This results in a reduced contact area between the medium 22 and the downward sloped surface 61*b*, which facilitates the discharging of the medium 22 in the discharging direction F over the downward sloped surface 61*b*.

When a medium 22 discharged in the discharging direction F travels over the upward sloped surface 62*b*, provision of the convex portion 62*e* extending in the discharging direction F brings a state in which the medium 22 is partially raised from the upward sloped surface 62*b* due to the convex portion 62*e*. This results in a reduced contact area between the medium 22 and the upward sloped surface 62*b*. This facilitates the discharging the medium 22 in the discharging direction F over the upward sloped surface 62*b*.

When a medium 22 discharged in the discharging direction F travels over the sloped surface 63*b*, provision of the convex portion 63*e* extending in the discharging direction F brings a state in which the medium 22 is partially raised from the sloped surface 63*b* due to the convex portion 63*e*. This results in a reduced contact area between the medium 22 and the sloped surface 63*b*, which facilitates the discharging of the medium 22 in the discharging direction F over the sloped surface 63*b*.

When a medium 22 with A3 size illustrated by the dashed line in the drawing and a medium 22 with A1 size illustrated by the solid line in the drawing are discharged from the discharging portion 18 of the printing apparatus 2 and are loaded on the loading portion 60 as illustrated in FIG. 7, the trailing edges (end on the upstream side in the discharging direction F) 22*a* of the media 22 with the individual sizes overlap with the groove 61*a*, and is disposed on the inner side of the groove 61*a*, in plan view when viewed in the Z direction. In other words, in each of the media 22 with different sizes, the positions of the trailing edges 22*a* of the media 22 in the discharging direction F are substantially the same, and the trailing edges 22*a* of the media 22 with different sizes are each disposed within the groove 61*a* in plan view that is viewed in the Z direction.

In a state where the medium 22 is loaded on the loading portion 60, the trailing edge 22*a* of the medium 22 descends toward the −Z direction side, and the position of the trailing edge 22*a* of the medium 22 is low as compared with a case where the groove 61*a* is not formed.

When the trailing edge 22*a* of a medium 22 discharged earlier ascends in a case in which a plurality of media 22 is discharged in the printing apparatus 2, the leading edge of another medium 22 discharged later hits against the trailing edge 22*a* that has ascended. This may result in the medium 22 discharged later being less likely to be discharged appropriately in the discharging direction F.

In the present exemplary embodiment, the groove 61*a* is provided on the first loading portion 61. This lowers the trailing edge 22*a* side of the medium 22 that has been discharged earlier. Thus, the medium 22 that is discharged later is more likely to be discharged appropriately in the discharging direction F, as compared with a case where the trailing edge 22*a* of the medium 22 that is discharged earlier ascends.

When a medium 22 with A3 size illustrated by the dashed line in FIG. 7 and a medium 22 with A1 size illustrated by the solid line in FIG. 7 are discharged from the discharging portion 18 of the printing apparatus 2 and are loaded on the loading portion 60, the position of the leading edge 22*b* (end on the downstream side in the discharging direction F) of the medium 22 with A3 size differs from the position of the leading edge 22*b* of the medium 22 with A1 size in plan view when viewed in the Z direction.

In a case of the medium 22 with A3 size, the leading edge 22*b* of the medium 22 with A3 is disposed above the upward sloped surface 62*b*. Thus, when a plurality of media 22 with A3 size is discharged from the discharging portion 18 of the printing apparatus 2 and is loaded on the loading portion 60, the plurality of media 22 with A3 size is loaded on the first loading portion 61 and the second loading portion 62.

In a case of a medium 22 with A1 size, the leading edge 22*b* of the medium 22 with size A1 is disposed outside the third loading portion 63, that is, disposed downstream of the third loading portion 63 in the discharging direction F. Thus, when a plurality of media 22 with A1 size is discharged from the discharging portion 18 of the printing apparatus 2 and is loaded on the loading portion 60, the plurality of media 22 with A1 size is loaded on the first loading portion 61, the second loading portion 62, and the third loading portion 63. In addition, the leading edge 22*b* of the medium 22 with A1 size is disposed outside the third loading portion 63, and hangs down toward the −Z direction.

Although illustration is not given, in a case of a medium 22 with A2 size, the leading edge 22*b* of the medium 22 with A2 size is disposed above the upward sloped surface 63*b*. Thus, when a plurality of media 22 with A2 size is discharged from the discharging portion 18 of the printing apparatus 2 and is loaded on the loading portion 60, the plurality of media 22 with A2 size is loaded on the first loading portion 61, the second loading portion 62, and the third loading portion 63.

When a plurality of media 22 having different sizes is discharged from the discharging portion 18 of the printing apparatus 2 and is loaded on the loading portion 60, not only a medium 22 with A3 size but also a medium 22 having a size greater than A3 size are loaded on the first loading portion 61 and the second loading portion 62. The third loading portion 63 carries a medium 22 having a size greater than the A3 size.

Thus, when a plurality of media 22 having different sizes is discharged from the discharging portion 18 of the printing apparatus 2 and is loaded on the loading portion 60, the volume of the media 22 to be loaded on the loading portion 60 is larger on the side of the first loading portion 61 and the second loading portion 62, and is smaller on the third loading portion 63 side.

In other words, on the basis of media 22 having sizes ranging from A0 size to A4 size, the dimensions of the first loading portion 61, the second loading portion 62, and the third loading portion 63 in the discharging direction F are designed such that a medium 22 having a smaller size (for example, A3 size to A4 size) is more likely to be loaded on the first loading portion 61 and the second loading portion 62, and a medium 22 having a larger size (for example, A0 size to A2 size) is more likely to be loaded on the first loading portion 61, the second loading portion 62, and the third loading portion 63. Here, when the number of prints on a medium 22 having a larger size is less than the number of prints on a medium 22 having a smaller size, the volume of the media 22 to be loaded on the loading portion 60 decreases in the order of the first loading portion 61, the second loading portion 62, and the third loading portion 63.

Thus, when the first pressing portion 81 and the second pressing portion 82 are considered to be able to press the medium 22 when the medium 22 is loaded across at least the first loading portion 61 and the second loading portion 62.

A pressing portion 80 that can press the medium 22 loaded on the loading portion 60 is provided downstream of the discharging portion 18 of the printing apparatus 2 in the discharging direction F.

As illustrated in FIGS. 4 and 7, the pressing portion 80 includes: at least one first pressing portion 81 that can press a medium 22 loaded on the first loading portion 61; at least one second pressing portion 82 that can press a medium 22 loaded on the second loading portion 62; and at least one third pressing portion 83 that can press a medium 22 loaded on the third loading portion 63.

The first pressing portion 81 is disposed so as to be spaced apart from the downward sloped surface 61*b*. In other words, the displacement of the first pressing portion 81 is restricted in a direction away from the downward sloped surface 61*b*. The second pressing portion 82 is disposed so as to be spaced apart from the upward sloped surface 62*b*. In other words, the displacement of the second pressing portion 82 is restricted in a direction away from the upward sloped surface 62*b*.

The third pressing portion 83 is disposed so as to be spaced apart from the upward sloped surface 63*b*.

The first pressing portion 81, the second pressing portion 82, and the third pressing portion 83 each include a rotatable roller 90 that can be brought into contact with a medium 22. The first pressing portion 81, the second pressing portion 82, and the third pressing portion 83 are configured such that the roller 90 is brought into contact with a medium 22 to press the medium 22.

The roller 90 is rotatable when the pressing portions 81, 82, and 83 press a medium 22. Thus, as compared with a case where the roller 90 is fixed so as not to rotate, the medium 22 is easily discharged in the discharging direction F when the medium 22 is discharged in the discharging direction F in the loading portion 60.

Here, as illustrated in FIGS. 7 and 8, the roller 90 of the first pressing portion 81 and the roller 90 of the second pressing portion 82 can be moved to an upper limit position and a lower limit position. FIG. 7 illustrates a state in which the roller 90 of the first pressing portion 81 and the roller 90 of the second pressing portion 82 are moved to the lower limit position. FIG. 8 illustrates a state in which the roller 90 of the first pressing portion 81 and the roller 90 of the second pressing portion 82 are moved to the upper limit position. As illustrated in FIG. 7, the roller 90 of the first pressing portion 81 is configured to be spaced apart from the downward sloped surface 61*b* at the lower limit position. In addition, as illustrated in FIG. 7, the roller 90 of the second pressing portion 82 is configured to be spaced apart from the upward sloped surface 62*b* at the lower limit position. In other words, the first pressing portions 81 is configured to be able to be moved to the upper limit position and the lower limit position, and be spaced apart from the downward sloped surface 61*b* at the lower limit position. The second pressing portion 82 is configured to be able to be moved to the upper limit position and the lower limit position, and be spaced apart from the upward sloped surface 62*b* at the lower limit position.

Note that it is only necessary that one of or both of the first pressing portion 81 and the second pressing portion 82 are configured to include a contact portion (for example, roller 90) that can be brought into contact with a medium 22.

For example, it may be possible to employ a configuration in which the first pressing portion 81 includes a rotatable contact portion that can be brought into contact with a medium 22, and the second pressing portion 82 includes a non-rotatable contact portion that can be brought into contact with the medium 22. For example, it may be possible to employ a configuration in which the second pressing portion 82 includes a rotatable contact portion that can be brought into contact with a medium 22, and the first pressing portion 81 includes a non-rotatable contact portion that can be brought into contact with the medium 22.

The third pressing portion 83 may have a configuration including a rotatable contact portion (for example, roller 90) that can be brought into contact with a medium 22, or a configuration including a non-rotatable contact portion that can be brought into contact with the medium 22, as with the first pressing portion 81 and the second pressing portion 82.

As illustrated in FIG. 4, six pieces of the first pressing portions 81 are attached to a frame 51B extending in the X direction. In other words, six pieces of the first pressing portions 81 are disposed along the X direction. The first pressing portion 81 can swing in a direction in which the roller 90 moves toward the downward sloped surface 61*b*, or in a direction in which the roller 90 moves away from the downward sloped surface 61*b*.

Three pieces of the second pressing portions 82 are attached to each of four frames 51C extending in the discharging direction F. In other words, three pieces of the second pressing portions 82 are disposed along the discharging direction F. Four pieces of frames 51C, each of which has the three second pressing portions 82 attached thereto, are disposed along the X direction, and are each fixed to a frame 51D extending in the X direction. In other words, four pieces of the second pressing portions 82 are disposed along the X direction. Furthermore, the frame 51D extending in the X direction is fixed to a frame 51E extending in the discharging direction F.

In the medium loading device 3, three pieces of the second pressing portions 82 are disposed along the discharging direction F, and four pieces of the second pressing portions 82 are disposed along the X direction. In other words, the medium loading device 3 has 12 pieces of the second pressing portions 82 in total. The 12 pieces of the second pressing portions 82 are supported by the frames 51C, 51D, and 51E, and can swing in a direction in which the roller 90 moves toward the upward sloped surface 62*b*, or in a direction in which the roller 90 moves away from the upward sloped surface 62*b*.

Note that the frames 51C, 51D, 51E are examples of a frame body according to the present application.

The frame 51E is rotatably attached to a frame 51F extending in the Z direction through a rotary shaft 68. The frames 51C and 51D can rotate relative to the frame 51F, as with the frame 51E. Furthermore, the 12 pieces of the second pressing portions 82 supported by the frames 51C, 51D, and 51E can integrally rotate with respect to the frame 51F.

Note that the frame 51F is an example of a support portion according to the present application. In other words, the medium loading device 3 includes a frame body that supports the second pressing portion 82, and a support portion that rotatably supports the frame body.

One third pressing portions 83 is attached to a frame 51G extending in the discharging direction F. Four pieces of the frames 51G, each of which has one third pressing portion 83 attached thereto, are disposed along the X direction. Thus, four pieces of the third pressing portions 83 are disposed along the X direction.

The third pressing portion 83 does not swing and the position of the roller 90 does not change.

Each of the plurality of first pressing portions 81 includes a first arm member 81*a* that is supported by the frame 51C in a swingable manner, and the roller 90 that is rotatably supported by the top end of the first arm member 81*a*. Each of the plurality of second pressing portions 82 includes a second arm member 82*a* that is supported by the frame 51C in a swingable manner, and the roller 90 that is rotatably supported by the top end of the second arm member 82*a*.

As illustrated in FIG. 7, the second arm member 82*a* includes a main body 82*a*1 including two slits 82*b* extending in the Z direction, and a support portion 82*a*2 to which the roller 90 is attached. A support shaft 86 is disposed in the slit 82*b*. The support shaft 86 is attached to the frame 51C, sticks out from the frame 51C in the −X direction, and supports the second arm member 82*a* in a swingable manner. The second arm member 82*a* can swing in a direction toward the upward sloped surface 62*b* or in a direction away from the upward sloped surface 62*b*. The roller 90 attached to the second arm member 82*a* also can swing in a direction toward the upward sloped surface 62*b* or in a direction away from the upward sloped surface 62*b*.

Note that a cover (not illustrated) covers a portion where the support shaft 86 is disposed in the slit 82*b*, that is, the portion where the second pressing portion 82 is attached to the frame 51C.

In FIG. 7, a portion of the support 82*a*2 on a side opposite to the portion where the roller 90 is attached is sloped in a direction away from the upward sloped surface 62*b*. A portion of the support portion 82*a*2 that is sloped in a direction away from the upward sloped surface 62*b* is referred to as a sloped portion K. The portion of the support portion 82*a*2 that continues with the sloped portion K and to which the roller 90 is attached is referred to as a support portion L.

As described above, the second arm member 82*a* includes the sloped portion K that is sloped in a direction away from the upward sloped surface 62*b*, and also includes the support portion L that continues with the sloped portion K and to which the roller 90 is attached. The support portion L is disposed downstream of the sloped portion K in the discharging direction F, and extends longer in the discharging direction F than the sloped portion K.

With the second arm member 82*a* being provided with the sloped portion K sloped in a direction away from the upward sloped surface 62*b*, it is possible to facilitate introduction of a medium 22 between the upward sloped surface 62*b* and the second arm member 82*a* even when the medium 22 is warped in a direction away from the upward sloped surface 62*b*.

When the volume of the media 22 loaded on the second loading portion 62 increases and the thickness of media 22 loaded on the second loading portion 62 increases, the state of slope of the second arm member 82*a* changes from the state illustrated in FIG. 7 to the state illustrated in FIG. 8. Specifically, the state of slope of the second arm member 82*a* changes from a state in which the support portion L of the second arm member 82*a* is disposed so as to intersect the upward sloped surface 62*b* as illustrated in FIG. 7, to a state in which the support portion L of the second arm member 82*a* is disposed so as to be in parallel to the upward sloped surface 62*b* as illustrated in FIG. 8.

This brings about a change from a state in which the roller 90 attached to the second arm member 82*a* presses a medium 22 as illustrated in FIG. 7, to a state in which the support portion L of the second arm member 82*a* together with the roller 90 presses the medium 22 as illustrated in FIG. 8. Thus, as the volume of the media 22 loaded on the second loading portion 62 increases, the media 22 are pressed by the roller 90 as well as the support portion L of the second arm member 82*a*. This makes the media 22 less likely to move, which allows the media 22 to be loaded on the second loading portion 62 in a stable manner, as compared with a case where the media 22 are pressed only by the roller 90.

As illustrated in FIGS. 4 and 7, four pieces of the third pressing portions 83 are disposed along the X direction, and are attached to the frame 51G. The third pressing portions 83 do not swing, and the positions of the rollers 90 of the third pressing portions 83 do not change.

As described above, when the number of prints on a large medium 22 having a size greater than or equal to A2 size is less than the number of prints on a small medium 22 having a size less than A2 size, the volume of the media 22 loaded on the third loading portion 63 is less than the volume of the media 22 loaded on the first loading portion 61 and the second loading portion 62. Thus, change in thickness of media 22 loaded on the third loading portion 63 is small, as compared with the first loading portion 61 and the second loading portion 62.

In a case of the first loading portion 61 and the second loading portion 62 where change in thickness of media 22 to be loaded is large, the position of the roller 90 of the first pressing portion 81 and the position of the roller 90 of the second pressing portion 82 change in accordance with the thickness of the media 22 to be loaded. On the other hand, in a case of the third loading portion 63 where the change in thickness of the media 22 to be loaded is small, it is not necessary to change the position of the roller 90 of the third pressing portion 83 in accordance with the thickness of the media 22 to be loaded.

Thus, the present exemplary embodiment is configured such that the positions of the rollers 90 of the first loading portion 61 and the second loading portion 62 change, and the position of the roller 90 of the third loading portion 63 does not change. Note that the third loading portion 63 may be configured to swing and the position of the roller 90 of the third pressing portion 83 may change.

Figure 9:
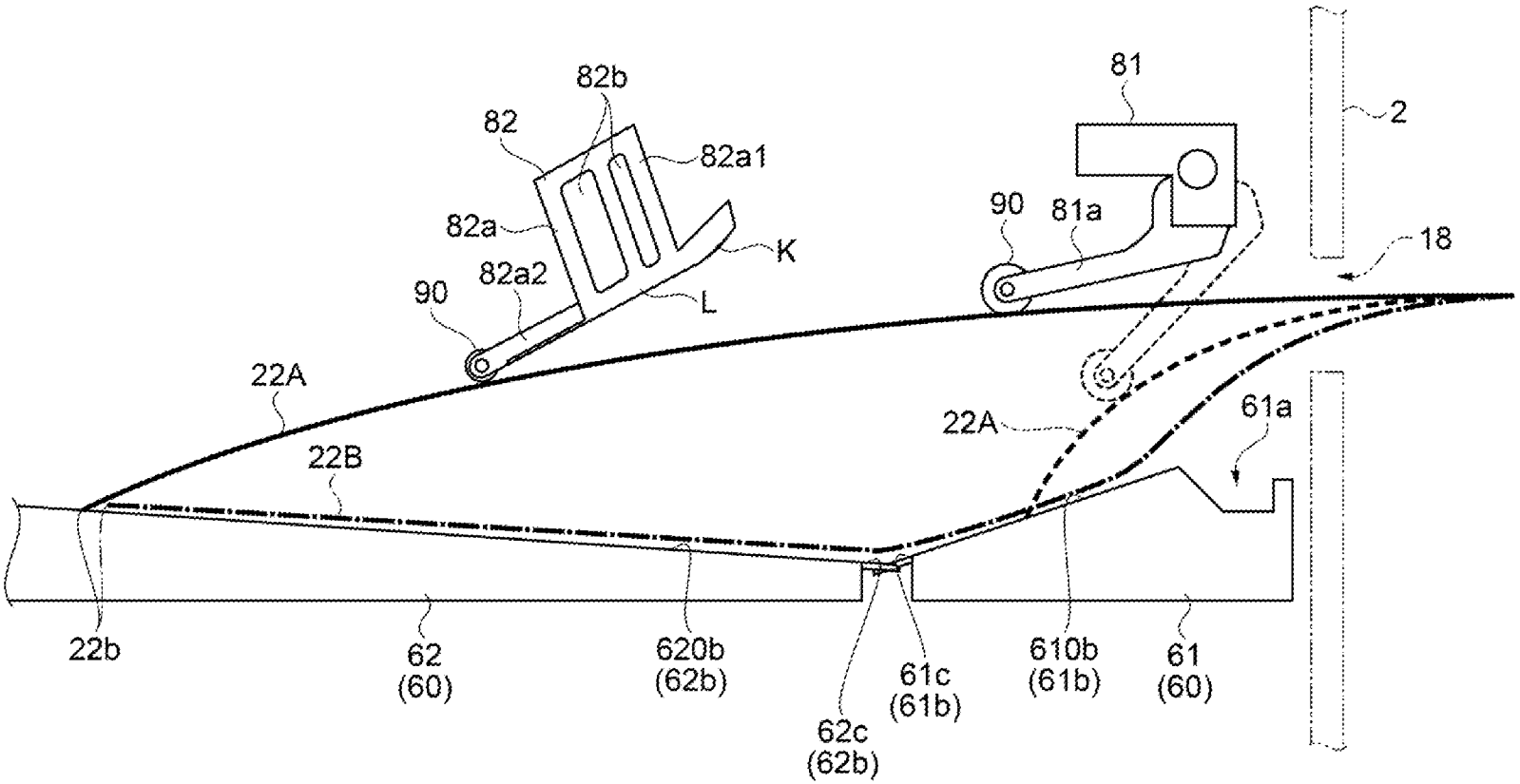
FIG. 9 is a schematic view illustrating an initial state in which a medium is discharged from a discharging portion of a printing apparatus to the medium loading device.

FIG. 9 is a schematic view illustrating an initial state in which the medium 22 is discharged from the discharging portion 18 of the printing apparatus 2 to the medium loading device 3.

Note that, in FIG. 9, when a medium 22 is discharged from the discharging portion 18 of the printing apparatus 2, a rigid medium 22A with a short discharge distance is illustrated by the dashed line, a rigid medium 22A with a long discharge distance is illustrated by the solid line, and a soft medium 22B with a long discharge distance is illustrated by the dot-dash line.

As illustrated in FIG. 9, in the first loading portion 61, the downward sloped surface 61*b* includes a portion 610*b* (hereinafter, referred to as a downward sloped surface 610*b*) where the downward sloped protrusion 61*c* is not provided, and a portion where the downward sloped protrusion 61*c* is provided. In other words, the downward sloped surface 61*b* includes the downward sloped surface 610*b* and the downward sloped protrusion 61*c*.

The downward sloped protrusion 61*c* is provided at the end (end on the downstream side in the discharging direction F) of the first loading portion 61 in the discharging direction F, and protrudes from the downward sloped surface 610*b* toward the discharging direction F. The downward sloped surface 610*b* is disposed upstream of the downward sloped protrusion 61*c* in the discharging direction F. The downward sloped surface 610*b* and the downward sloped protrusion 61*c* form a discharging path for a medium 22 along the discharging direction F.

In the second loading portion 62, the upward sloped surface 62*b* includes a portion 620*b* (hereinafter, referred to as an upward sloped surface 620*b*) where the upward sloped protrusion 62*c* is not provided, and a portion where the upward sloped protrusion 62*c* is provided. In other words, the upward sloped surface 62*b* includes the upward sloped surface 620*b* and the upward sloped protrusion 62*c*.

The upward sloped protrusion 62*c* is provided at the end (end on the upstream side in the discharging direction F) of the second loading portion 62 in a direction opposite to the discharging direction F, and protrudes from the upward sloped surface 620*b* toward a direction opposite to the discharging direction F. The upward sloped surface 620*b* is disposed downstream of the upward sloped protrusion 62*c* in the discharging direction F. The upward sloped protrusion 62*c* and the upward sloped surface 620*b* form a discharging path for a medium 22 along the discharging direction F.

When a medium 22 is discharged from the discharging portion 18 of the printing apparatus 2 in the discharging direction F, the leading edge 22*b* of the medium 22 first travels in the discharging direction F while being in contact with the downward sloped surface 610*b* of the first loading portion 61, and then, travels in the discharging direction F while being in contact with the downward sloped protrusion 61*c* of the first loading portion 61. After this, the leading edge 22*b* of the medium 22 travels in the discharging direction F while being in contact with the upward sloped protrusion 62*c* of the second loading portion 62, and then, travels in the discharging direction F while being in contact with the upward sloped surface 620*b* of the second loading portion 62.

When viewed in the X direction, the downward sloped protrusion 61*c* of the first loading portion 61 and the upward sloped protrusion 62*c* of the second loading portion 62 are disposed so as to partially overlap at a boundary portion between the first loading portion 61 and the second loading portion 62. When a medium 22 is discharged in the discharging direction F at the boundary portion between the first loading portion 61 and the second loading portion 62, the leading edge 22*b* of the medium 22 travels in the discharging direction F over the downward sloped protrusion 61*c* of the first loading portion 61. Then, from a portion where the downward sloped protrusion 61*c* and the upward sloped protrusion 62*c* overlap, the leading edge 22*b* of the medium 22 travels in the discharging direction F over the upward sloped protrusion 62*c* of the second loading portion 62.

In this manner, when a medium 22 is discharged from the discharging portion 18 of the printing apparatus 2 in the discharging direction F, the discharging path for the medium 22 along the discharging direction F is formed by the downward sloped surface 610*b* of the first loading portion 61, the downward sloped protrusion 61*c* of the first loading portion 61, the upward sloped protrusion 62*c* of the second loading portion 62, and the upward sloped surface 620*b* of the second loading portion 62. In other words, the downward sloped surface 61*b* and the upward sloped surface 62*b* form the discharging path through which the medium 22 is discharged.

In addition, when the discharging path for a medium 22 along the discharging direction F is viewed in the X direction, the discharging path, which is formed by the downward sloped surface 610*b* of the first loading portion 61, the downward sloped protrusion 61*c* of the first loading portion 61, the upward sloped protrusion 62*c* of the second loading portion 62, and the upward sloped surface 620*b* of the second loading portion 62, has a substantially V-shape. The V-shaped discharging path does not include any constituent element that may block discharging of a medium, the constituent element including, for example, a configuration in which a raised ridge is provided in the discharging path for the medium 22. Thus, as compared with a case where any block (for example, a raised ridge) exists, the medium 22 smoothly travels in the discharging direction F, which facilitates discharging of it in the discharging direction F.

When a rigid medium 22A is discharged from the discharging portion 18 of the printing apparatus 2, the winding shape due to the roll body 25 has a strong effect as compared with a case where a soft medium 22B is discharged. Thus, the rigid medium 22A curls in a direction away from the downward sloped surface 61*b* of the first loading portion 61.

More specifically, in the early stage in which the rigid medium 22A is discharged from the discharging portion 18 of the printing apparatus 2, the rigid medium 22A bends convexly toward the +Z direction as indicated by the dashed line in the drawing, which results in the rigid medium 22A, except for the leading edge 22*b*, ascending from the downward sloped surface 61*b* of the first loading portion 61. The first pressing portion 81 presses the rigid medium 22A so as to reduce the ascending of the medium 22A from the downward sloped surface 61*b*.

If the ascending of the rigid medium 22A from the downward sloped surface 61*b* is too large, the rigid medium 22A curls in a spiral manner, and the leading edge of the rigid medium 22A is more likely to be caught, for example, on one of or both of the downward sloped surface 610*b* of the first loading portion 61 and the upward sloped surface 620*b* of the second loading portion 62. This makes it difficult for the rigid medium 22A to be discharged in the discharging direction F. In the present exemplary embodiment, the first pressing portion 81 presses the rigid medium 22A. This reduces the ascending of the rigid medium 22A from the downward sloped surface 61*b*. This also makes it easy for the leading edge of the rigid medium 22A to slide, for example, on one of or both of the downward sloped surface 610*b* of the first loading portion 61 and the upward sloped surface 620*b* of the second loading portion 62, which facilitates discharging of the rigid medium 22A in the discharging direction F.

As the rigid medium 22A travels on the second loading portion 62, the rigid medium 22A is pressed by the second pressing portion 82, as indicated by the solid line in the drawing. When the rigid medium 22A travels on the second loading portion 62, the ascending of the medium 22A has already been suppressed due to the first pressing portion 81. This eliminates the need for the second pressing portion 82 to press the medium 22A with strong pressing force. Thus, the second pressing portion 82 is only necessary to press the medium 22A with small pressing force, as compared with the first pressing portion 81.

If the second pressing portion 82 presses the rigid medium 22A with a stronger pressing force than the first pressing portion 81, a portion of the medium 22A that is pressed by the second pressing portion 82 is locally curved. This results in the leading edge 22*b* of the medium 22A ascending from the sloped surface 62*b* of the second loading portion 62, which may make it difficult for the medium 22 to be discharged in the discharging direction F.

Thus, in the present exemplary embodiment, when the first pressing portion 81 and the second pressing portion 82 press the medium 22, the pressing force of the second pressing portion 82 is smaller than the pressing force of the first pressing portions 81.

For example, by adding a spring to the first pressing portion 81 and the second pressing portion 82, and varying the spring constant of the spring, it is possible to adjust the pressing force of the first pressing portion 81 and the second pressing portion 82. For example, by using an elastic member as a member that supports the roller 90 of the first pressing portion 81 and the second pressing portion 82 and varying the modulus of elasticity of the elastic member, it is possible to adjust the pressing force of the first pressing portion 81 and the second pressing portion 82. For example, by varying the mass of the first arm member 81*a* of the first pressing portion 81 and the mass of the second arm member 82*a* of the second pressing portion 82, it is possible to adjust the pressing force of the first pressing portion 81 and the pressing force of the second pressing portion 82. For example, by varying the number of first pressing portions 81 and the number of second pressing portions 82, it is possible to adjust the pressing force of the first pressing portion 81 and the pressing force of the second pressing portion 82.

As illustrated in FIG. 4, three pieces of the second pressing portions 82 are arranged along the discharging direction F. The three pieces of the second pressing portions 82 arranged along the discharging direction F each press a medium 22 loaded on the second loading portion 62 with smaller pressing force than that of the first pressing portion 81, thereby reducing the curl of the medium 22.

Note that the three pieces of the second pressing portions 82 arranged along the discharging direction F may each have the same pressing force, or may have different degrees of pressing force. For example, the pressing force of the three pieces of the second pressing portions 82 arranged along the discharging direction F may be changed such that the pressing force increases on the upstream side in the discharging direction F, and decreases on the downstream side in the discharging direction F.

When a soft medium 22B is discharged from the discharging portion 18 of the printing apparatus 2, the effect of the winding shape due to the roll body 25 is smaller as compared with a case where a rigid medium 22A is discharged. Thus, the soft medium 22B is less like to curl in a direction away from the downward sloped surface 61*b* of the first loading portion 61. Thus, as indicated by the dot-dash line in FIG. 9, the soft medium 22B travels in the discharging direction F along the downward sloped surface 61*b* of the first loading portion 61.

Furthermore, when a soft medium 22B reaches the second loading portion 62, the soft medium 22B travels in the discharging direction F along the upward sloped surface 62*b* of the second loading portion 62.

In the present exemplary embodiment, when a soft medium 22B is discharged from the discharging portion 18 of the printing apparatus 2, the first pressing portion 81 and the second pressing portion 82 are disposed away from the soft medium 22B and do not press the soft medium 22B.

If the first pressing portion 81 and the second pressing portion 82 press the soft medium 22B, the soft medium 22B discharged earlier may be discharged in the discharging direction F together with another soft medium 22B discharged later. This may cause a plurality of soft media 22B loaded on the loading portion 60 to be rubbed with each other, resulting in a deterioration in quality of an image formed on the soft medium 22B.

For the reasons described above, when a soft medium 22B is discharged from the discharging portion 18 of the printing apparatus 2, it is preferable to employ a configuration in which the first pressing portion 81 and the second pressing portion 82 are disposed away from the soft medium 22B and do not press the soft medium 22B.

In this manner, the rigid medium 22A discharged from the discharging portion 18 of the printing apparatus 2 is discharged in the discharging direction F through a discharge path for the medium 22 in a state of being pressed by the pressing portion 80, the discharging path being formed by the downward sloped surface 61*b* and the upward sloped surface 62*b*. The soft medium 22B discharged from the discharging portion 18 of the printing apparatus 2 is discharged in the discharging direction F through the discharging path for the medium 22 in a state of being not pressed by the pressing portion 80, the discharging path being formed by the downward sloped surface 61*b* and the upward sloped surface 62*b*.

The operation described above can be achieved by appropriately adjusting the restriction of displacement of the first pressing portion 81 in a direction away from the downward sloped surface 61*b* and the restriction of displacement of the second pressing portion 82 in a direction away from the upward sloped surface 62*b*, on the basis of types of and the number of media 22 loaded on the loading portion 60.

The discharge path for a medium 22 formed by the downward sloped surface 61*b* and the upward sloped surface 62*b* does not include any constituent element that may block discharging of a medium, the constituent element including, for example, a configuration that includes a raised ridge in a discharging path for the medium 22. Thus, the medium 22A, 22B can be discharged appropriately in the discharging direction F, and it is possible to avoid a malfunction in which the medium 22A, 22B is difficult to be discharged in the discharging direction F.

In addition, the first pressing portion 81 and the second pressing portion 82 can press the medium 22. When the first pressing portion 81 presses, for example, a rigid medium 22A that is more likely to curl, the leading edge of the rigid medium 22A first easily slide on the downward sloped surface 61*b*, and is more likely to travel through a V-shape discharging path. Then, the second pressing portion 82 presses the rigid medium 22A that has reached the upward sloped surface 62*b*. This facilitates sliding of the leading edge of the curling rigid medium 22A on the upward sloped surface 62*b*. Thus, it is possible to prevent discharging of the rigid medium 22A from being blocked.

2. Modification Example

In the exemplary embodiment described above, the first loading portion 61 is provided in the medium loading device 3, and is a constituent element of the medium loading device 3. The first loading portion 61 may be provided in the printing apparatus 2 and may be a constituent element of the printing apparatus 2.

In other words, the printing apparatus 2 may include the discharging portion 18 that discharges a medium 22, and a first loading portion 61 configured to load the medium 22, the first loading portion 61 including the downward sloped surface 61*b* provided downstream in the discharging direction F in which the discharging portion 18 discharges the medium 22, the downward sloped surface 61*b* being configured to be sloped downward in the discharging direction F.

In this case, the medium loading device 3 includes the second loading portion 62 configured to load the medium 22, the second loading portion 62 including the upward sloped surface 62*b* provided downstream of the first loading portion 61 in the discharging direction F, the upward sloped surface 62*b* being configured to be sloped upward in the discharging direction F, and also includes the plurality of pressing portions 80 provided downstream of the discharging portion 18 in the discharging direction F and configured to press the medium 22 loaded on the loading portion 60.

In the exemplary embodiment described above, the first loading portion 61 includes the downward sloped surface 61*b* and the second loading portion 62 includes the upward sloped surface 62*b*. However, the configuration is not limited to this. For example, the first loading portion 61 may include an upward sloped surface. In this case, it is only necessary that an absolute value of a gradient of the upward sloped surface of the first loading portion 61 in the discharging direction F is smaller than an absolute value of a gradient of the upward sloped surface 62*b* of the second loading portion 62 in the discharging direction F in a manner such that the upward sloped surface of the first loading portion 61 and the upward sloped portion 62*b* of the second loading portion 62 form a V-shaped discharging path. In this manner, it is also possible to achieve an operation and effect similar to those of the exemplary embodiment described above.

Contents derived from the Embodiments will be described below.

A medium loading device provides a medium loading device used for a printing apparatus including a discharging portion discharging a medium. The medium loading device includes: a loading portion configured to load the medium discharged from the discharging portion; and a plurality of pressing portions provided downstream of the discharging portion in a discharging direction of the medium, the plurality of pressing portions being configured to press the medium loaded on the loading portion. In the medium loading device, the loading portion includes: a first loading portion that includes a downward sloped surface sloping downward in the discharging direction and that is provided downstream of the discharging portion in the discharging direction; and a second loading portion that includes an upward sloped surface sloping upward in the discharging direction and that is provided downstream of the first loading portion in the discharging direction. The downward sloped surface and the upward sloped surface form a discharging path through which the medium is discharged. The plurality of pressing portions includes: a first pressing portion configured to press the medium loaded on the first loading portion; and a second pressing portion configured to press the medium loaded on the second loading portion.

The discharge path formed by the downward sloped surface and the upward sloped surface does not include, for example, any constituent element that may block discharging of a medium, the constituent element including a configuration in which a raised ridge is provided in the discharging path for a medium. Thus, the medium discharged from the discharging portion of the printing apparatus is appropriately discharged along the discharging path formed by the downward sloped surface and the upward sloped surface.

In addition, even when the medium discharged from the discharge portion of the printing apparatus is curved because it has been wound around and so on, the curling of the medium is reduced with pressing by the first pressing portion and the second pressing portion. Thus, the medium discharged from the discharging portion of the printing apparatus is discharged appropriately along the discharging path formed by the downward sloped surface and the upward sloped surface, and is appropriately loaded on the loading portion.

A medium loading device provides a medium loading device used for a printing apparatus including a discharging portion discharging a medium, and a first loading portion configured to load the medium, the first loading portion including a downward sloped surface sloping downward in the discharging direction and provided downstream in a discharging direction, in which the discharging portion discharges the medium. The medium loading device includes a second loading portion configured to load the medium and including an upward sloped surface sloping upward in the discharging direction and provided downstream of the first loading portion in the discharging direction. The medium loading device also includes a plurality of pressing portions configured to press the medium loaded at the first loading portion and the second loading portion and provided downstream of the discharging portion in the discharging direction. The plurality of pressing portions includes a first pressing portion configured to press the medium loaded on the first loading portion, and also includes a second pressing portion configured to press the medium loaded on the second loading portion.

The discharging path formed by the downward sloped surface and the upward sloped surface does not include any constituent element that may block discharging of the medium, the constituent element including, for example, a configuration in which a raised ridge is provided in the discharging path. Thus, the medium discharged from the discharging portion of the printing apparatus is appropriately discharged along the discharging path formed by the downward sloped surface and the upward sloped surface.

For example, even when the medium is curled because it has been wound around and so on, the curling of the medium is reduced with pressing by the first pressing portion and the second pressing portion. Thus, the medium discharged from the discharging portion of the printing apparatus is discharged appropriately along the discharging path formed by the downward sloped surface and the upward sloped surface, and is appropriately loaded on the first loading portion and the second loading portion.

When the first pressing portion and the second pressing portion press a medium, it is preferable to configure the medium loading device such that the pressing force of the second pressing portion is smaller than the pressing force of the first pressing portion.

The first pressing portion is disposed more upstream in the discharging direction than the second pressing portion. The medium that curls because it has been wound around and so on is first pressed by the first pressing portion, and then pressed by the second pressing portion.

The first pressing portion presses a medium of which curling is not reduced. For example, the curling is not appropriately reduced if the pressing force is weak. Thus, the pressing force of the first pressing portion is preferably stronger, as compared with the second pressing portion that presses a medium of which curling has already been reduced.

The second pressing portion presses a medium of which curling has already been reduced by the first pressing portion. For example, a new malfunction may occur if pressing is too strong. Thus, the pressing force of the second pressing portion is preferably weak, as compared with the first pressing portion that presses a medium of which curling has not yet been reduced.

It is preferable to configure the medium loading device such that one of or both of the first pressing portion and the second pressing portion include a roller that is rotatable and contactable with the medium.

With one of or both of the first pressing portion and the second pressing portion being provided with the rotatable roller that can be brought into contact with a medium, the medium is easily discharged in the discharging direction, as compared with a case where the rotatable roller that can be brought into contact with the medium is not provided.

It is preferable that the medium loading device include a frame body supporting the second pressing portion, and also include a support portion rotatably supporting the frame body.

With the frame body that supports the second pressing portion and the support portion that rotatably supports the frame body, it is possible for a user to easily remove, from the loading portion, a bunch of media loaded on the medium loading device.

It is preferable to configure the medium loading device such that the first pressing portion can move to an upper limit position and a lower limit position and is spaced apart from the downward sloped surface at the lower limit position, and the second pressing portion can move to an upper limit position and a lower limit position and is spaced apart from the upward sloped surface at the lower limit position.

The first pressing portion is spaced apart from the downward sloped surface, and moves in a direction toward the downward sloped surface or in a direction away from the downward sloped surface. The second pressing portion is spaced apart from the upward sloped surface, and moves in a direction toward the upward sloped surface or in a direction away from the upward sloped surface.

When a medium curls because it has been wound around or the like, the first pressing portion and the second pressing portion are brought into contact with the curling medium to press the curling medium, thereby reducing the curling of the medium. When the medium is not curled, the first pressing portion and the second pressing portion are spaced apart from the medium, and do not press the medium.

In this way, the pressing states of the first pressing portion and the second pressing portion relative to a medium can be changed depending on the state of the medium.

It is preferable to configure the medium loading device such that a plurality of first protrusions protruding in the discharging direction and constituting the downward sloped surface are provided at an end of the first loading portion in the discharging direction, and a plurality of second protrusions protruding in an opposite direction that is opposite to the discharging direction and constituting the upward sloped surface are provided at an end of the second loading portion in the opposite direction. In addition, each of the plurality of first protrusions and each of the plurality of second protrusions are disposed alternately in an intersecting direction that intersects the discharging direction, and overlap when viewed in the intersecting direction.

The first protrusion (hereinafter, referred to as a downward sloped protrusion) that constitutes the downward sloped surface is provided at the end of the first loading portion. The second protrusion (hereinafter, referred to as an upward sloped protrusion) that constitutes the upward sloped surface is provided at the end of the second loading portion. In addition, the downward sloped protrusion and the upward sloped protrusion are disposed alternately in the intersecting direction that intersects the discharging direction, and the downward sloped protrusion and the upward sloped protrusion are disposed so as to overlap when viewed in the intersecting direction that intersects the discharging direction.

At the boundary portion between the first loading portion and the second loading portion, this allows the medium to be discharged in the discharging direction along the downward sloped protrusion and the upward sloped protrusion. In other words, at the boundary portion between the first loading portion and the second loading portion, the downward sloped protrusion and the upward sloped protrusion form a discharging path for a medium.

The discharging path for a medium at the boundary portion between the first loading portion and the second loading portion does not include any constituent element that may block discharging of the medium, the constituent element including, for example, a configuration in which a raised ridge is provided in the discharging path for the medium. Thus, the medium is appropriately discharged along the discharging path formed by the downward sloped protrusion and the upward sloped protrusion. In other words, it is possible to prevent the medium from being caught at the boundary portion between the first loading portion and the second loading portion.

It is preferable to configure the medium loading device such that a convex portion extending in the discharging direction is provided at the downward sloped surface and the upward sloped surface.

With the convex portion extending in the discharging direction being provided on the downward sloped surface, the medium partially ascends from the downward sloped surface due to the convex portion. This results in a reduction in a contact area between the medium and the downward sloped surface, which facilitates discharging of the medium in the discharging direction on the downward sloped surface.

With the convex portion extending in the discharging direction being provided on the upward sloped surface, the medium partially ascends from the upward sloped surface due to the convex portion. This results in a reduction in a contact area between the medium and the upward sloped surface, which facilitates discharging of the medium in the discharging direction on the upward sloped surface.

It is preferable to configure the medium loading device such that a convex portion extending in the discharging direction is provided at at least one of the first protrusion and the second protrusion.

With the convex portion extending in the discharging direction being provided on the first protrusion, the medium partially ascends from the first protrusion due to the convex portion. This results in a reduction in a contact area between the medium and the first protrusion, which facilitates discharging of the medium in the discharging direction on the first protrusion.

With the convex portion extending in the discharging direction being provided on the second protrusion, the medium partially ascends from the second protrusion due to the convex portion. This results in a reduction in a contact area between the medium and the second protrusion, which facilitates discharging of the medium in the discharging direction on the second protrusion.

What is claimed is:

1. A medium loading device used for a printing apparatus including a discharging portion discharging a medium, the medium loading device comprising:

a loading portion configured to load the medium discharged from the discharging portion; and a plurality of pressing portions provided downstream of the discharging portion in a discharging direction of the medium, the plurality of pressing portions being configured to press the medium loaded on the loading portion, wherein the loading portion includes:

a first loading portion that includes a downward sloped surface sloping downward in the discharging direction and that is provided downstream of the discharging portion in the discharging direction; and a second loading portion that includes an upward sloped surface sloping upward in the discharging direction and that is provided downstream of the first loading portion in the discharging direction, the downward sloped surface and the upward sloped surface form a discharging path through which the medium is discharged, and the plurality of pressing portions includes:

a first pressing portion configured to press the medium loaded on the first loading portion;

a second pressing portion configured to press the medium loaded on the second loading portion; and a frame body that includes:

a frame that supports the second pressing portion, the frame being above the loading portion and having a long side in the discharging direction.

2. The medium loading device according to claim 1, wherein when the first pressing portion and the second pressing portion press the medium, pressing force of the second pressing portion is smaller than pressing force of the first pressing portion.

3. The medium loading device according to claim 1, wherein one of or both of the first pressing portion and the second pressing portion include a roller that is rotatable and contactable with the medium.

4. The medium loading device according to claim 1, comprising a support portion rotatably supporting the frame body.

5. The medium loading device according to claim 1, wherein the first pressing portion is configured to move to an upper limit position and a lower limit position, and is spaced apart from the downward sloped surface at the lower limit position, and the second pressing portion is configured to move to an upper limit position and a lower limit position, and is spaced apart from the upward sloped surface at the lower limit position.

6. The medium loading device according to claim 1, wherein a plurality of first protrusions protruding in the discharging direction and constituting the downward sloped surface, is provided at an end of the first loading portion in the discharging direction, a plurality of second protrusions protruding in an opposite direction that is opposite to the discharging direction and constituting the upward sloped surface, is provided at an end of the second loading portion in the opposite direction, and each of the plurality of first protrusions and each of the plurality of second protrusions are disposed alternately in an intersecting direction that intersects the discharging direction, and overlap when viewed in the intersecting direction.

7. The medium loading device according to claim 6, wherein a convex portion extending in the discharging direction is provided at at least one of the first protrusion and the second protrusion.

8. The medium loading device according to claim 1, wherein a convex portion extending in the discharging direction is provided at the downward sloped surface and the upward sloped surface.

9. A medium loading device used for a printing apparatus including a discharging portion discharging a medium, and a first loading portion configured to load the medium, the first loading portion including a downward sloped surface sloping downward in the discharging direction and provided downstream in a discharging direction, in which the discharging portion discharges the medium, the medium loading device comprising:

a second loading portion configured to load the medium and including an upward sloped surface sloping upward in the discharging direction and provided downstream of the first loading portion in the discharging direction; and a plurality of pressing portions configured to press the medium loaded at the first loading portion and the second loading portion, and provided downstream of the discharging portion in the discharging direction, wherein the plurality of pressing portions includes:

a first pressing portion configured to press the medium loaded on the first loading portion;

a second pressing portion configured to press the medium loaded on the second loading portion; and a frame body that includes:

a frame that supports the second pressing portion, the frame being above the loading portion and having a long side in the discharging direction.

* * * * *